US005803104A

United States Patent [19]

Pollen

[11] Patent Number: 5,803,104

[45] Date of Patent: Sep. 8, 1998

[54] BIMINI COVER FOR A DECK OF A WATER CRAFT

[76] Inventor: Randall Paul Pollen, 1237 E. 900 N., Milford, Ind. 46542

[21] Appl. No.: 785,812

[22] Filed: Dec. 28, 1996

[51] Int. Cl.[6] ..... B63B 17/00; E04H 15/06

[52] U.S. Cl. ..... 135/96; 114/361; 135/88.01; 135/88.03; 135/90; 135/96; 135/97; 135/123; 135/126; 135/133; 135/117

[58] Field of Search ..... 114/361; 135/88.01, 135/88.03, 88.13, 88.14, 90, 95, 96, 97, 122, 123, 126, 128, 132, 133, 143, 147, 151, 155, 117

[56] References Cited

U.S. PATENT DOCUMENTS

| | | | |
|---|---|---|---|
| 1,592,356 | 7/1926 | Goldberg et al. | 135/117 X |
| 2,513,764 | 7/1950 | Vonder Ahe | 114/361 |
| 2,829,660 | 4/1958 | Wester et al. | 114/361 X |
| 2,832,361 | 4/1958 | Smith | 135/117 X |
| 2,833,296 | 5/1958 | Woodruff, Sr. | 114/361 |
| 3,051,967 | 9/1962 | Beach | 135/133 X |
| 3,285,259 | 11/1966 | Hale | 114/361 X |
| 3,307,566 | 3/1967 | Hale | 114/361 |
| 4,683,900 | 8/1987 | Carmichael | 135/88.01 |
| 5,303,667 | 4/1994 | Zirkelbach et al. | 114/361 |
| 5,520,139 | 5/1996 | King et al. | 114/361 |

*Primary Examiner*—Wynn E. Wood
*Attorney, Agent, or Firm*—Leo H. McCormick, Jr.

[57] ABSTRACT

A frame for a bimini cover for a deck of a water craft. The support structure has a first end frame retained in a fixed position with respect to the deck and a second end frame pivotally connected to the first end frame. The frame has first and second support members each of which have a first end fixed to the deck and a second end fixed to the first end frame to define first triangular members to hold the first end frame in a fixed position with respect to the deck. The second end frame is moved from a closed position to an opened position to selectively extend a canopy over the deck. First and second strut members are secured to the first end frame and joined to the second end frame to define second triangular members. The strut members are adjustable after being joined to the second end frame to hold the second end frame at a fixed arcuate distance from the first end frame while maintaining a predetermined tension on the canopy. The first and second triangular members substantially transmitting any forces applied to the canopy directly into the deck without introducing distortion into the first end frame.

9 Claims, 2 Drawing Sheets

BIMINI COVER FOR A DECK OF A WATER CRAFT

This invention relates to support structure for a bimini cover located on a deck of a water craft. The support structure has an adjustable strut member such that a desired tension may be maintained on an extended canopy after an extended period of use and environmental exposure.

It is common for water craft to have a rail around the deck to keep both passengers and any cargo not tied down on the deck. To provide easy access to the deck, gates are often located in the rail. In addition, protection from the elements for passengers and any cargo on the deck is often achieved through the use of a bimini cover which may be attached to the rail or directly to the deck. Such covers are designed to be retained in a closed positions and when desired extended over a portion of the deck. Unfortunately, after an extended period of time, the dimension of the canvas in a bimini cover may change as a result of exposure to wind, rain and sun. More importantly, when extended the support structure of the bimini cover must be capable to withstand dynamic forces generated when the water craft moves through the water. Since such forces increase as a function of both the speed of the water craft and wind speed, it is possible the have a combined force which is the equivalent of 50 miles per hour. To assist the support structure in holding the bimini cover on the deck when in the opened position, it is common to attach straps or ties to the deck to maintain a desired tension on the bimini cover. This arrangement is adequate for most operations, however on some water craft, the egress gates are located in the middle of the rail along the deck and as a result unless the straps are untied a passenger either has to duck under or step over a strap.

It is an object to the present invention to improve the egress safety associated with a water craft through the elimination of the tie down straps involved in securing a bimini cover to the deck.

SUMMARY OF THE INVENTION

In the present invention, the bimini cover for a water craft includes an adjustable strut for positioning a pivotal second end frame with respect to a first end frame of the support structure to maintain a desired tension on a canopy. The first end frame is maintained in a fixed position by linkage which is attached to the deck to define a first triangular force vector while the adjustable strut along with the first and second end frames define a second triangular force vector. With the canopy in the opened position, forces produced on the canopy by the wind and movement of the water craft are transferred through triangular force vectors to the deck.

BRIEF DESCRIPTION OF THE DRAWINGS

FIG. 2(*a*) is a perspective view of the support structure of FIG. 2;

FIG. 2(*b*) is a side view of the support structure of FIG. 2 with force vectors placed on the various members;

DETAILED DESCRIPTION OF THE INVENTION

Figure 1:
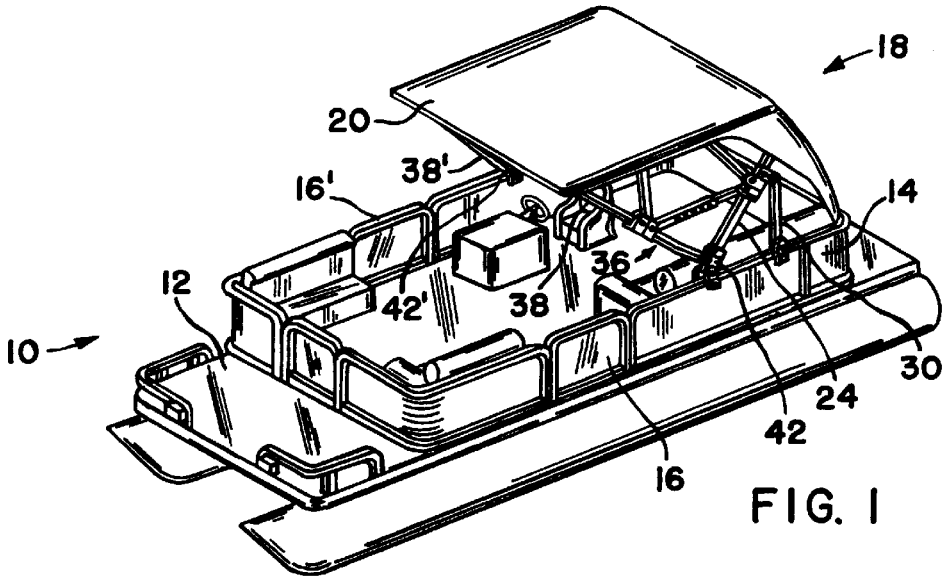
FIG. 1 is a prospective view of a water craft with a bimini cover for the deck made according to the principals of this invention.

The water craft 10 shown in FIG. 1 has a deck 12 with a rail 14 located on a portion of its periphery. The rail 14 has gates 16,16' through which passengers may get on and off the deck 12. Passengers and cargo on the deck 12 are protected from the elements by a bimini cover 18 shown in the opened position The support structure 22 for the bimini cover 18, see FIGS. 2 and 2(*a*), retains a canopy 20 in an opened position without effecting passengers egress through gates 16,16'.

Figure 2:
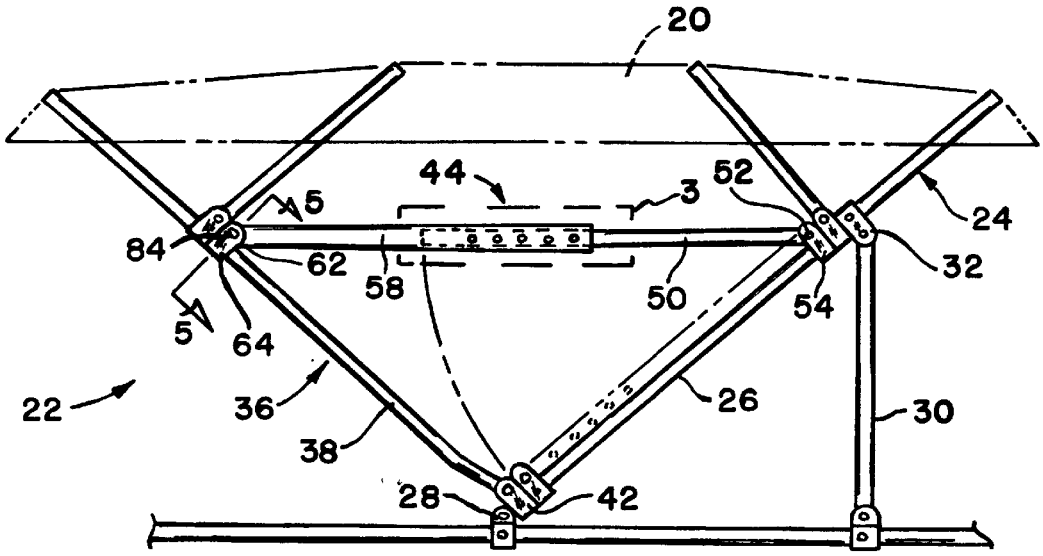
FIG. 2 is a side view of one of the support structure for bimini cover of FIG. 1.
Figure 3:
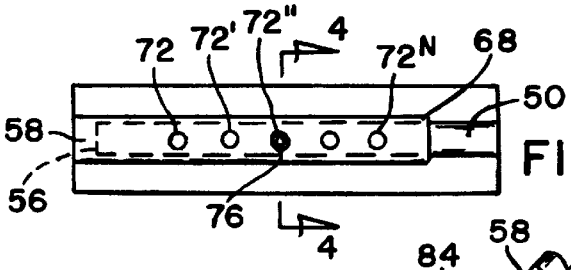
FIG. 3 is a view of the circumscribed portion 3 of FIG. 2.

In more particular detail, the bimini cover 18 as illustrated in FIGS. 2 and 2(*a*) includes first 24 and second 36 end frames each of which is made a unitary member or tube. The first end frame 24 is retained in a fixed position on deck 12 while second end frame 36 is allow to pivot about the first end frame 24 to move a canopy from a closed positioned to an opened position.

The first 24 and second 36 end frames include support structure 22 which retains the canopy 20. The support structure for the sides are identical and as a result a component identified by a number on one side of the support is identified on the other side by the same number with ' added thereto. The support structure 22 has a shape defined parallel first 26 second 26' legs connected by a first cross member 27. The first 26' and second legs are secured to the deck 12 by brackets 28' and retained in the fixed position by first 30 and second support members. The first 30' and second 30' support members are secured to the deck 12 and to brackets 32 on the first leg 26' and the second leg of the first end frame 24 to define first and second triangular force vectors, respectively between the first 26 and second 26' legs and deck 12 such that the first 30 and second 30' support members are positioned in a vertical position substantially perpendicular to the deck 12.

The unitary structure for the second end frame 36 with a shape defined by parallel third 38 and fourth 38' legs connected by a second cross over member 40. The third 38 and fourth 38' legs are connected to brackets 42,42' respectively located on the first leg 26' and second leg of the first end frame 24.

The second end frame 36 is maintained in an opened position by first 44 and second 44' strut members. The first strut member 44 is connected to the first leg 26 of the first end frame 24 and selectively joined to the third leg 38 of the second end frame 36 while the second strut member 44' is connected to the second leg of the first end frame 24 and the fourth 38' leg 26' of the second end frame 36 to define substantially triangular frames for directing the third and fourth force vectors to the deck 12 by way of brackets 28.

Each of the strut members 44' is identical and same description applies whether for both sets of legs (one and three; two and four) with respect to the illustrations in FIGS. 2,2(*a*),3, 4 and 5. The strut member 44 is made up of first 50 and second 58 reinforcing bars. The first reinforcing bar 50 has a first end 52 secured to a bracket 54 retained on the first leg 26 of the first end frame 24 and a second end 56. A plurality of sequential radial openings 60, 60' . . . 60 are located adjacent the second end 56 of the first reinforcing bar 50. The second reinforcing bar 58 has a first end 62 secured to a bracket 64 located on the third leg 38 of the second end frame 36 and a second end 68. The second reinforcing bar 58 has an axial opening or internal surface of tube 70 which extends for a predetermined distance from the second end 68 toward the first end 62. A plurality of radial openings 72,72' . . . 72 extend from the axial opening 70 adjacent the second end 68. The second end 56 of the first reinforcing bar 50 is designed to slide in the axial opening 70 of the second reinforcing bar 58 to define a unitary structure.

Figure 4:
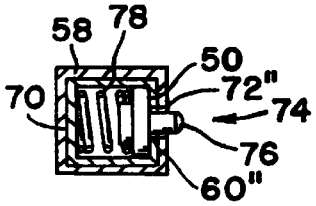
FIG. 4 is a view along line 4—4 of FIG. 3.
Figure 5:
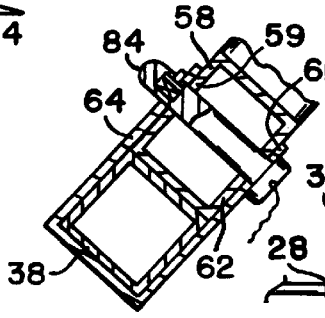
FIG. 5 is a view along line 5—5 of FIG. 2.

A retractable first pin 84, see FIG. 5, is tethered to the second reinforcing bar 58 adjacent the second end 62. The second reinforcing bar 58 is connected to the third leg 38 by this first pin 84 after the second end 56 of the first reinforcing bar 50 is located in axial bore opening 70 of the second reinforcing bar 58. The second reinforcing bar 58 is slidable with respect to the first reinforcing bar 50 to define a desired length for the strut member 44. The strut member 44 has a locking mechanism 74, see FIG. 4, with a button member 76 which is retained in the interior of the first reinforcing bar 50. A spring 78 urges flange 77 against the reinforcing bar 50 such that button member 76 extends through opening 60". The length of the button member 76 is sufficient to pass through both openings 60" and 72" to form a solid connection between the first reinforcing bar 50 and second reinforcing bar 58.

MODE OF OPERATION OF INVENTION

Figure 6:
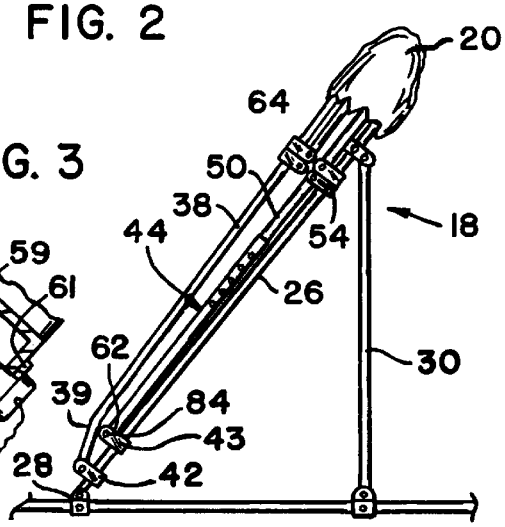
FIG. 6 is a side view of the bimini cover of FIG. 1 in a closed position.
Figure 2A:
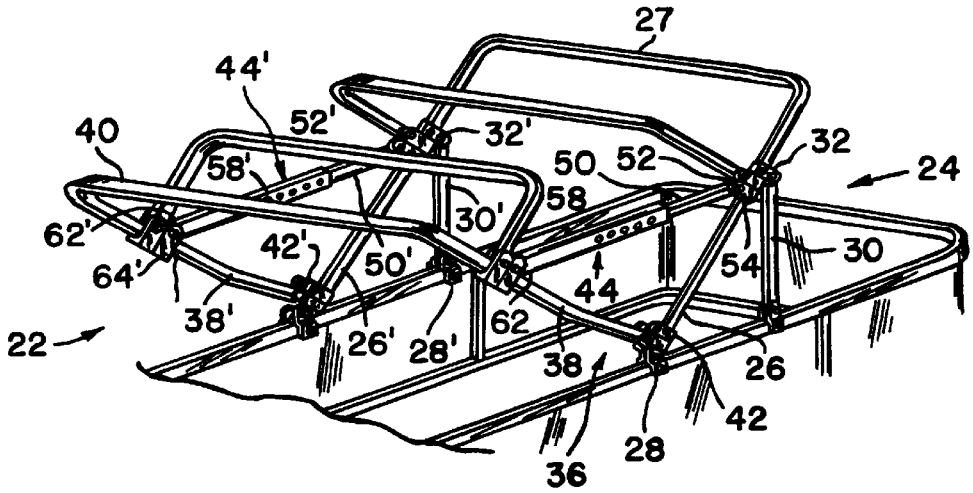
Figure 2B:
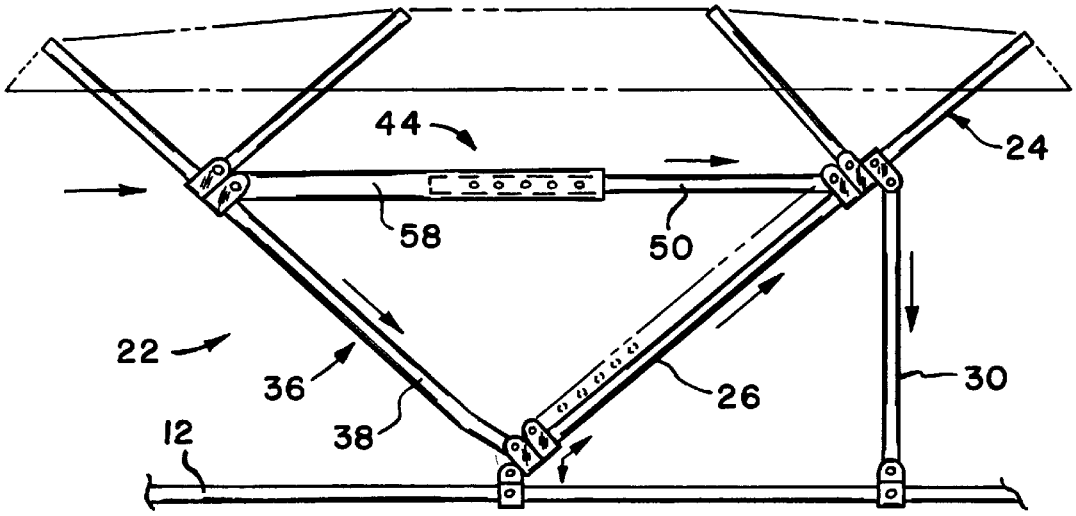

The bimini cover 18 is shown in FIG. 6 in the closed position. The third 38 and fourth 38' legs each have an offset 39 adjacent the connection with bracket 42 such that the third 38 and fourth 40 legs of the second end frame 36, struts 44' and first 30 and second legs of the first end frame 24 are aligned in a compact and substantially parallel planes.

When an operator desires to extend the canopy 20 over the deck 12, the second end frame 36 is pivoted from the closed position as shown in FIG. 6 to an opened position as shown in FIG. 1. Initially, end 62 on the second reinforcing bar 58 is retained in storage bracket 43 and pin 84 must be pulled. Thereafter end 62 is rotated up to connection bracket 64 and pin 84 inserted through openings 61 in bracket 64 and opening 59 in the second reinforcing bar 58 to connect the strut member 44 to the third leg and define a triangular frame composed of the first leg 26, third leg 38 and strut member 44 to establish a third triangular frame for receiving and directing forces to the deck 12 illustrated by the force vectors in FIG. 2(*b*). This procedure is repeated for the strut member 44' associated with the second leg 26' and fourth leg 38' to define a second triangular frame therebetween for receiving and directing forces to the deck 12. After the pins 84' have been connected to the brackets 64' on the third 38 and fourth legs 38', a force is applied to the second end frame 36 such that the button 76' on the locking mechanism 74' extends through the openings 60" and 72" to fix the length of the strut members 44'. The length of the strut members 44' is dependent on the desired tension on the canopy 20 and can be adjusted after a period of use to compensate for changes as the canopy dries or streches from exposure to the environment.

In order to test the strength of the support structure 22, the bimini cover 18 was subjected to a wind developed when traveling 50 miles per hour. The strut members 44' and associated triangular frames directed the forces through the force vectors into the deck without distortion in either the first end frame 24, second end frame 36 or the support members 30 which links or fixes the first end frame in a stationary position on the deck.

I claim:

1. A bimini cover for the deck of a water-craft comprising:

a first end frame having a unitary structure, said first end frame having parallel first and second legs connected by a first cross-over member, said first and second legs each having ends fixed to said deck;

a first support member fixed to said deck and to said first leg of said first end frame to define a first triangular member with said first leg and deck such that said first support member is positioned in a fixed vertical position substantially perpendicular to said deck;

a second support member fixed to said deck and to said second leg of said first end frame to define a second triangular member with said second leg and deck such that said second support member is positioned in a fixed vertical position substantially perpendicular to said deck;

a second end frame having a unitary structure, said second end frame having parallel third and fourth legs connected by a second cross-over member, said third and fourth legs being pivotally connected to said first end frame adjacent the first end of said first and second legs;

a canopy secured to said first and second cross-over members of said first and second end frames;

a first strut member connected to said first leg and selectively joined to said third leg member to define a substantially third triangular member with said first leg and third leg; and a second strut member connected to second leg and selectively joined to said fourth leg member to define a substantially fourth triangular member with said second leg and fourth leg, said first and second strut members being adjustable after being joined with said third and fourth legs, respectively, to hold said second end frame at a desired arcuate distance from said first end frame to maintain a predetermined torque on said canopy, said first, second, third and fourth triangular members substantially directing any forces applied to said canopy directly into said deck without distorting said first end frame.

2. Support structure for bimini cover located on a deck of a water craft, said support structure having a first end frame retained in a fixed position with respect to said deck and a second end frame pivotally connected to said first end frame for selectively extending a canopy attached to said first and second end frames from a closed position to an opened position, the improvement comprising:

linkage means fixed to said deck and connected to said first end frame, said linkage means, said deck and said first end frame defining first triangular members to maintain said first end frame in a fixed position with respect to said deck;

strut means secured to said first end frame and selectively joined to said second end frame to define said opened position, said strut means, first end frame and second end frame defining second triangular members which are connected with said first triangular members to substantially transmit any forces applied to said canopy directly into said deck without introducing distortion into the first end frame, said strut means being adjustable after being joined to said second end frame for holding said second end frame a fixed arcuate distance from said first end frame while maintaining a predetermined tension on said canopy.

3. In the support structure as recited in claim 2 wherein said first end frame is a unitary member with a first leg having an end fixed to said deck, a second leg having an end fixed to said deck and a first cross-over member which extends between said first and second legs.

4. In the support structure as recited in claim 3 wherein said second end frame is a unitary member with a third leg having an end pivotally fixed to said end of said first leg of said first end frame, a fourth leg having an end pivotally fixed to said end of said second leg of said first end frame and a second cross-over member which extends between said third and fourth legs.

5. In the support structure as recited in claim 4 wherein said linkage means includes:

a first support having a first end fixed to said deck and a second end fixed to said first leg to define a first portion of said first triangular members to maintain said first end frame in said fixed position with respect to said deck.

6. In the support structure as recited in claim 5 wherein said linkage means includes:

a second support having a first end secured to said deck and a second end secured to said second leg to define a second portion of said first triangular members to maintain said first end frame in said fixed position with respect to said deck.

7. In the support structure as recited in claim 6 wherein said strut means includes:

a first reinforcing bar having a first end secured to said first leg of said first end frame and a second end, said first reinforcing bar having a first plurality of sequential radial openings adjacent said second end;

a second reinforcing bar having a first end selective secured to said third leg of said second end frame and a second end, said second reinforcing bar having an axial opening extending for a predetermined distance from said second end toward said first end and a second plurality of radial openings extending from said axial opening adjacent said second end; and a retractable first pin tethered to said second reinforcing bar adjacent said second end, said second reinforcing bar being connected to said third leg by said first pin after said second end of said first reinforcing bar is located in said axial opening of said second reinforcing bar and slidable therein to a first position; and a first locking mechanism retained in said first reinforcing bar and extending through a radial opening in said second plurality of radial openings in said second reinforcing bar and a radial opening in said first plurality of radial openings in said first reinforcing bar to define a first portion of said second triangular members between said first and third legs, said first portions of said first and second triangular members resisting any force that may develop which would move said canopy from said opened position by transferring said force into said deck without substantially effecting the tension on said canopy.

8. In the support structure as recited in claim 7 wherein said strut means includes:

a third reinforcing bar having a first end secured to said second leg of said first end frame and a second end, said third reinforcing bar having a third plurality of sequential radial openings adjacent said second end;

a fourth reinforcing bar having a first end selectively secured to said third leg of said second end frame and a second end, said fourth reinforcing bar having an axial opening extending for a predetermined distance from said second end toward said first end and a fourth plurality of radial openings extending from said axial opening adjacent said second end; and a retractable second pin tethered to said fourth reinforcing bar adjacent said second end, said fourth reinforcing bar being connected to said fourth leg by said second pin after said second end of said third reinforcing bar is located in said axial opening of said fourth reinforcing bar and slidable therein to a selected position;

a second locking mechanism retained in said third reinforcing bar and extending through a radial opening in said fourth reinforcing bar and a radial opening in said third reinforcing bar to define a second portion of said second triangular members with said third and fourth legs, said second portion of said second triangular members assisting to resist any force that may develop which would move said canopy from said opened position by transferring said force into said deck without substantially effecting the tension on said canopy.

9. In the support structure as recited in claim 8 wherein said third and fourth legs of said second end frame each include:

an offset adjacent an attachment end with said first end frame, such offset allowing said first and second struts along with said third and fourth legs to be aligned in substantially parallel planes when in said closed position.

* * * * *